US008172043B2

(12) United States Patent
Hughes et al.

(10) Patent No.: US 8,172,043 B2
(45) Date of Patent: May 8, 2012

(54) ELEVATOR CROSS-DISPATCHING SYSTEM WITH INTER GROUP RELATIVE SYSTEM RESPONSE (IRSR) DISPATCHING

(75) Inventors: David M. Hughes, East Hartford, CT (US); Jerrold C. Bloom, Windsor, CT (US); John W. Grant, Simsbury, CT (US)

(73) Assignee: Otis Elevator Company, Farmington, CT (US)

( * ) Notice: Subject to any disclaimer, the term of this patent is extended or adjusted under 35 U.S.C. 154(b) by 466 days.

(21) Appl. No.: 12/447,127

(22) PCT Filed: Oct. 24, 2006

(86) PCT No.: PCT/US2006/041456

§ 371 (c)(1),
(2), (4) Date: Apr. 24, 2009

(87) PCT Pub. No.: WO2008/051217

PCT Pub. Date: May 2, 2008

(65) Prior Publication Data

US 2010/0025161 A1 Feb. 4, 2010

(51) Int. Cl.
*B66B 1/18* (2006.01)

(52) U.S. Cl. ..... 187/382; 187/391

(58) Field of Classification Search ..... 187/247, 187/248, 380–389, 391–393, 900
See application file for complete search history.

(56) References Cited

U.S. PATENT DOCUMENTS

| | | | | |
|---|---|---|---|---|
| 4,363,381 | A | 12/1982 | Bittar | |
| 4,793,443 | A | 12/1988 | MacDonald et al. | |
| 4,815,568 | A | 3/1989 | Bittar | |
| 4,844,204 | A | 7/1989 | Ovaska et al. | |
| 4,989,695 | A * | 2/1991 | Kubo | 187/247 |
| 5,146,053 | A | 9/1992 | Powell et al. | |
| 5,202,540 | A | 4/1993 | Auer et al. | |
| 5,357,064 | A | 10/1994 | Boyce et al. | |
| 5,389,748 | A | 2/1995 | Burke et al. | |
| 5,551,532 | A | 9/1996 | Kupersmith | |
| 5,672,853 | A | 9/1997 | Whitehall et al. | |
| 6,062,343 | A * | 5/2000 | Wang | 187/247 |
| 6,892,861 | B2 * | 5/2005 | Friedli | 187/247 |
| 6,935,465 | B2 * | 8/2005 | Friedli | 187/247 |
| 7,900,750 | B2 * | 3/2011 | Mattsson et al. | 187/247 |
| 7,918,318 | B2 * | 4/2011 | Friedli et al. | 187/247 |
| 2006/0191748 | A1 | 8/2006 | Sirag, Jr. | |
| 2011/0120813 | A1 * | 5/2011 | Flynn et al. | 187/384 |
| 2011/0147134 | A1 * | 6/2011 | Flynn et al. | 187/382 |

FOREIGN PATENT DOCUMENTS

WO 2006085846 A1 8/2006

OTHER PUBLICATIONS

International Search Report and Written Opinion, Feb. 22, 2007, 6 pages.

* cited by examiner

*Primary Examiner* — Anthony Salata
(74) *Attorney, Agent, or Firm* — Kinney & Lange, P.A.

(57) ABSTRACT

During elevator modernization, a cross-dispatching system receives hall calls and assigns each hall call to either a group of existing elevator car controllers or a group of new elevator car controllers. The cross-dispatching system creates an inter group relative system response (iRSR) value for the hall call for both the existing group of elevators and the new group of elevators, based upon information from each group such as car location, in-service status, load, and direction. If the group assigned the hall call does not answer the call within a redispatch time period, the cross-dispatching system again calculates the iRSR for each group and reassigns the hall call.

20 Claims, 2 Drawing Sheets

ELEVATOR CROSS-DISPATCHING SYSTEM WITH INTER GROUP RELATIVE SYSTEM RESPONSE (IRSR) DISPATCHING

BACKGROUND OF THE INVENTION

The present invention relates to elevator control during an elevator modernization project. In particular, it relates to dispatching of existing and new elevators in response to hall calls during an elevator modernization project.

During elevator modernization projects in occupied buildings, individual elevators are taken out of service and are upgraded to more modern equipment. This modernization typically includes the installation of a new elevator controller, and may also include a new car operating panel and a new wiring interface to the car controller.

As modernization of each car is completed, it is placed back into service, and another car is taken out of service to be modernized. Thus, during the modernization project, two groups of elevators will be in operation: the new group of elevators that have been upgraded, and an existing group of elevators that have not yet been upgraded. The two groups typically involve control systems that are not compatible with one another, and may be from different manufacturers. During the modernization process, coordination of the new and the existing elevator control systems is desirable, so that both systems are not responding to the same hall calls.

One approach to the dispatching of elevators during elevator modernization is described in the Boyce et al. U.S. Pat. No. 5,357,064 entitled ELEVATOR HALL CALL CROSS-CANCELLATION DEVICE. This cross-cancellation device operates with old elevator controllers that use relay logic to store the hall calls in a memory device. The new car controller can read the hall call memory through the cross-cancellation device. In this way, the new car controller can respond to calls that the existing car controller has not yet answered.

With elevator modernization projects that are now taking place, there is a need to modernize early microprocessor based elevator control systems. These systems do not include the relay logic for storing hall calls that was present in earlier elevator control systems, and which were utilized to perform the cross-cancellation function during modernization. In addition, there is a continuing need to reduce cost and to provide optimal elevator service during modernization projects.

BRIEF SUMMARY OF THE INVENTION

A cross-dispatching system distributes hall calls between a group of new elevators and a group of existing elevators during elevator modernization. The cross-dispatching system monitors information from the new group and the existing group and makes an assessment of the response times of the two groups. Based upon that evaluation, the cross-dispatching system assigns a hall call to one of the two groups.

DETAILED DESCRIPTION

Figure 1:
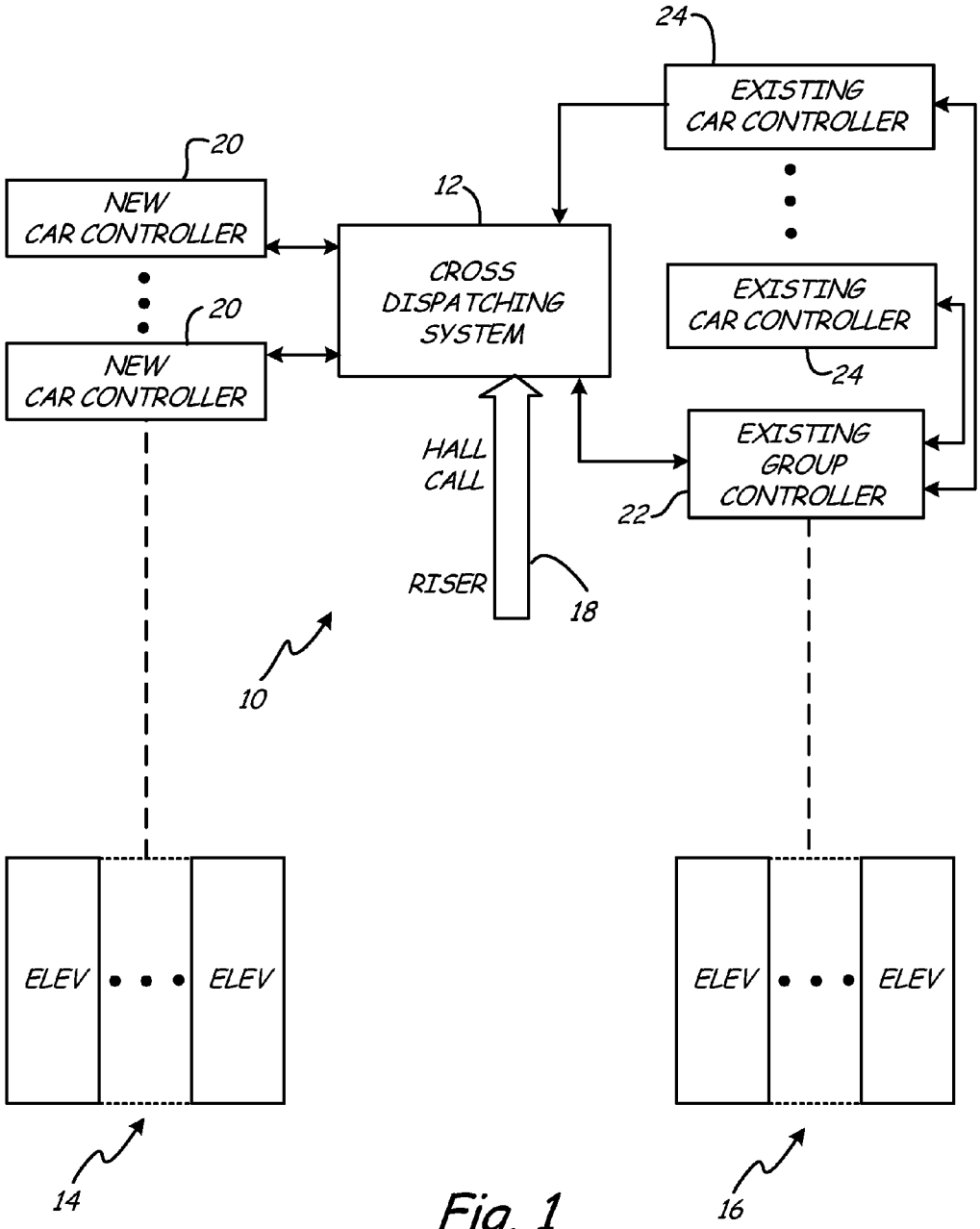
FIG. 1 is a block diagram showing cross-dispatching system for assigning hall calls among a group of existing elevator car controllers and a group of new elevator controllers.

FIG. 1 shows elevator system 10 undergoing modernization. During the modernization project, cross-dispatching system 12 coordinates operation of new elevator group 14 and existing elevator group 16. In response to hall calls from hall call riser 18, cross-dispatching system 12 determines whether to direct the hall call to new car controllers 20, or to existing group controller 22, which coordinates the operation of existing car controllers 24. For a given hall call, cross-dispatching system 12 determines a predicted response time for new car controllers 20 of new elevator group 14, and for existing car controllers 24 of existing elevator group 16. Depending upon which elevator group is likely to respond first to the hall call, cross-dispatching system 12 directs the hall call to that group. Cross-dispatching system 12 monitors a response to the hall call and can reassess and reassign the hall call if the assigned group has not responded within a redispatch time period.

Cross-dispatching system 12 receives hall calls from riser 18 through a group remote serial link (RSL). As part of the modernization system, new hall call buttons may be installed, and the remote serial link installed, if the existing elevator system 16 does not communicate a hall call over a serial link.

Cross-dispatching system 12 interacts with new car controllers 20 through a communications system in which each hall call is distributed and each controller 20 predicts a response time to service the hall call. New car controllers 20 share information, and make a determination as to which of the cars will respond to the hall call.

In one embodiment, cross-dispatching system 12 and new car controllers 20 communicate through a ring elevator communication system of the type described in the Auer et al. U.S. Pat. No. 5,202,540 and the Kupersmith U.S. Pat. No. 5,551,532. As described in the Auer et al. and the Kupersmith patents, each controller calculates a relative system response (RSR) value for each hall call received. New car controllers 20 share RSR values, and the new car controller with the most favorable RSR value responds to the hall call.

Calculation of the RSR value can be made based upon a number of factors. Examples of the use of RSR values in determining elevator call assignments are shown in the Bittar U.S. Pat. Nos. 4,363,381 and 4,815,568, and in the Powell et al. U.S. Pat. No. 5,146,053.

Cross-dispatching system 12 receives information from new car controllers 20 regarding status of each controller. The information received may include, for example, position of each car, direction of movement of the car, door state, and car availability (which may include in service status, as well as information on calls already assigned to that controller). Thus, cross-dispatching system 12 receives, on a periodic basis, status regarding each car of new group 14 with which cross-dispatching system 12 can assess likely response time to a new hall call.

In FIG. 1, existing elevator group 16 is shown having an architecture which includes existing group controller 22 and existing car controllers 24. If cross-dispatching system 12 directs a hall call to existing elevator group 16, that hall call is provided to existing group controller 22. Based upon car status information from existing controllers 24, existing group controller 22 makes a determination of which car should service the hall call, and provides control commands to the particular controller 24 that is assigned the hall call.

Cross-dispatching system 12 communicates with existing group controller 22, and also receives car status information from existing car controllers 24. The car status information is similar to that received from new car controllers 20 to the extent that car status information is available from existing group controller 22 and existing car controllers 24.

If existing group 16 has a car position matrix board attached to each car, position of the cars can be derived by a connection of cross-dispatching system 12 to each car position matrix board. Other information such as load state, may also be used when available to enhance dispatching performance.

When a hall call is received by cross-dispatching system 12, an inter-group relative system response (iRSR) value is calculated for both new group 14 and existing group 16. The hall call provides an indication of landing and direction (e.g., $4^{th}$ floor down). Cross-dispatching system 12 uses car status information received from new group 14 and from existing group 16 to calculate an iRSR value for each car. Cross-dispatching system 12 determines the best car's iRSR value for new group 14 and the best car's iRSR value for existing group 16. The call assignment is then made to the group having the better iRSR calculated value.

In calculating a car's iRSR value, cross-dispatching system 12 gives highest priority car status consideration to car availability. The next highest priority considerations include car direction, position, and/or state in that order. The iRSR based on a car status of a car moving toward the call and in the same direction will clearly win over a car moving in the opposite direction.

In the event that both groups 14 and 16 have identical best iRSR values, an iRSR bias will be given to one of the two groups. For example, a bias in the case of a tie may go to new group 14, since that group of elevators has been modernized, and should provide superior performance to existing group 16. In addition, new group 14 is growing as the modernization project continues, while the size of existing group 16 is decreasing, until there are no existing cars left and the modernization project is completed.

In a case where one of the two groups has no cars available, the iRSR bias will go to the other group that does have cars available. The unavailability of cars can occur, for example, when all of the cars in the group are in an inactive state (i.e. not in idle, normal or parking operational modes), or when the cars of that system are unable to access the particular landing at which the hall call originated.

In a special case, cross-dispatching system 12 may also assign a particular hall call to both group 14 and group 16. An example of this dual assignment may be in the case of an up lobby hall call. By assigning both groups 14 and 16 to answer the call, better service at the lobby may be achieved.

Figure 2:
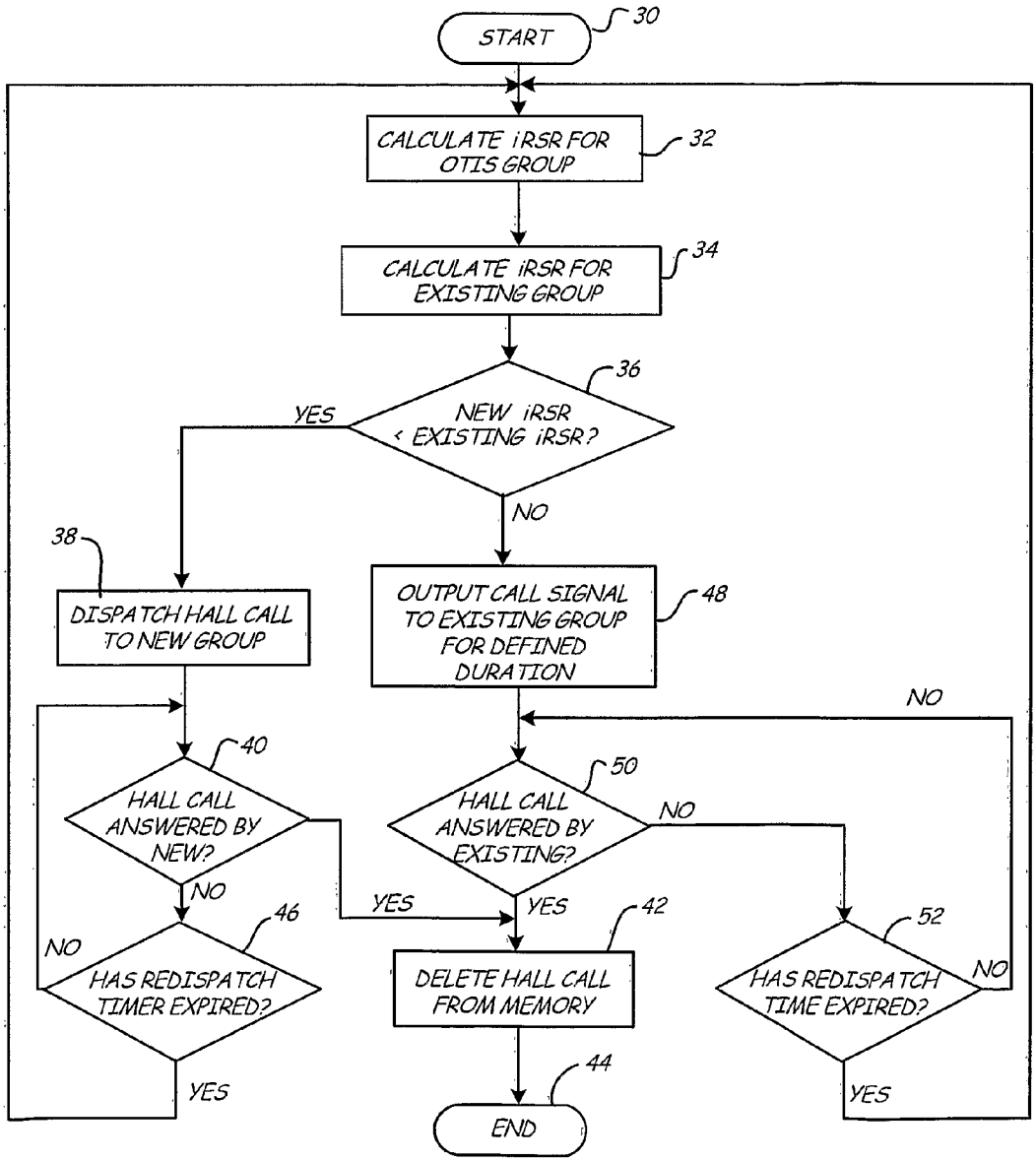
FIG. 2 is a flow diagram showing operation of the cross-dispatching system in assigning hall calls between a group of existing elevator controllers and a group of new elevator controllers.

FIG. 2 illustrates a flow diagram of the operation of cross-dispatching system 12. Operation starts upon receipt of a hall call from riser 18 (step 30). Cross-dispatching system 12 then calculates iRSR for each car of new elevator group 14 (step 32) and for each car of existing elevator group 16 (step 34).

Cross-dispatching system 12 then compares the best new group iRSR to the best existing group iRSR (step 36). If new group 14 has the more favorable iRSR value, cross-dispatching system 12 dispatches the hall call to new group 14 (step 38). At the same time, cross-dispatching system 12 starts a redispatch timer, which establishes a time within which the hall call must be answered.

Cross-dispatching system 12 is connected in the communication system of new group 14, and thus receives information from new car controllers 20 when they have answered hall calls assigned to them. Cross-dispatching system 12 checks to see whether an assigned hall call has been answered by the new system at step 40. If the hall call has been answered, cross-dispatching system 12 deletes a hall call from memory (step 42), and the process related to that particular hall call ends (step 44).

If the hall call has not been answered by the new group 14, cross-dispatching system 12 checks whether the dispatch timer has expired (step 46). If the redispatch timer has not expired, cross-dispatching system 12 again checks whether the hall call has been answered (step 40). This loop continues until the hall call is either answered and the hall call is deleted from memory (step 42) or the redispatch timer expires. If the redispatch timer has expired, cross-dispatching system 12 returns to steps 32 and 34 and recalculates iRSR values for both new group 14 and existing group 16. This recalculation is based upon the car status information available at that particular time. Thus a redispatch decision is made based upon current car status conditions.

At step 36, if the existing system iRSR value is more favorable, then cross-dispatching system 12 outputs a call signal to existing group controller 22 of existing group 16 (step 48). The hall call output is activated for a programmable amount of time (e.g., 500 milliseconds) so that existing group 16 will have sufficient time to acknowledge the hall call and generate an appropriate output, which normally illuminates the telltale indicator of existing group 16. This telltale signal is then used by cross-dispatching system 12 to determine when a hall call has been answered by existing group 16 (step 50). When cross-dispatching system 12 detects a falling edge of the telltale signal, the hall call is considered cancelled and is deleted from memory of cross-dispatching system 12. This also results in a ring message being sent to new car controllers 20.

If a hall call has not been answered by existing group 16, cross-dispatching system 12 checks whether the redispatch timer has expired (step 52). If the redispatch timer has not expired, cross-dispatching system 12 continues to monitor the telltale indicator to determine whether a hall call has been answered. If the redispatch timer has expired, then cross-dispatching system 12 returns to steps 32 and 34 and recalculates iRSR value for each car both new group 14 and existing group 16.

The use of cross-dispatching system 12 with iRSR calculation provides several benefits from elevator modernization projects. One significant benefit is a simplified hardware interface to existing elevator control group 16. Since cross-dispatching system 12 does not require the memory device of existing group 16 to retain the hall call, there is no need for special hardware to interface with specific memory devices (e.g. a relay based memory). This in turn significantly reduces engineering and installation time for new elevator control group 14, since there is no need to understand the specific memory device of the existing system in order to perform a modernization project. This reduces both the cost of the system and installation time.

Elevator hall call dispatching performance can be significantly improved with cross-dispatching system 12. Since both elevator groups 14 and 16 will not be answering the same hall calls, this allows each group to independently dispatch the hall calls and provide optimal elevator service to the building during the elevator modernization.

The ability to monitor information from existing elevator group 16 (such as individual car position, direction, door state, in service status, and other pertinent elevator information) allows cross-dispatching system 12 to predict response of both new group 14 and existing group 16, and to compare them in order to assign the hall call to the group best positioned to answer the call. This significantly improves overall dispatching performance during the modernization process.

Cross-dispatching system 12 may or may not use the same algorithm to predict response time that new group 14 and existing group 16 use to select a car to respond to a hall call. Based upon actual response times of new group 14 and existing group 16 when a hall call is assigned, cross-dispatching system 12 can adjust parameters used in calculating iRSR for each group. As a result, response time predictions can become more accurate with operating experience.

Cross-dispatching system 12 can be implemented using one of the controllers that will ultimately be used in new group 16. The controller is programmed with software to perform the cross-dispatching system functions, and operates until there is only one existing elevator remaining to be modernized. At that point, all but one elevator is in new group 14, and there are no elevators remaining in service in existing group 16. The cross-dispatching software can then be disabled or removed, and the controller can then be used to modernize the final elevator. Thus, implementation of cross-dispatching system 12 can be achieved with minimal hardware is expense and installation time.

Although FIG. 1 shows riser 18 connected directly to cross-dispatching system 12, other arrangements are possible. For example, riser 18 could be connected to one of the new car controllers 20 of new group 14, and hall calls could then be routed over a ring elevator communication 20 system to cross-dispatching system 12.

Although the present invention has been described with reference to preferred embodiments, workers skilled in the art will recognize that changes may be made in form and detail without departing from the spirit and scope of the invention.

The invention claimed is:

1. A control system for controlling operation of elevators during a modernization transition, the control system comprising:

a first system for controlling a first group of elevators to respond to assigned hall calls;

a second system for controlling a second group of elevators to respond to assigned hall calls; and a cross-dispatching system for receiving hall calls and assigning each hall call to one of the first system and the second system based upon an evaluation of predicted response times of the first group and the second group of elevators, wherein the cross-dispatching system reevaluates predicted response times and reassigns a previously assigned hall call if that hall call has not been serviced within a redispatch time period.

2. The control system of claim 1, wherein the cross-dispatching system receives from the first system car status information for elevators of the first group, and receives from the second system car status information for elevators of the second group.

3. The control system of claim 2, wherein for each hall call received the cross-dispatching system creates a first inter-group relative system response (iRSR) value for the first group of elevators based upon the car status information from the first system, and creates a second inter-group relative system response (iRSR) value for the second group of elevators based upon the car status information from the second system.

4. The control system of claim 3, wherein the cross-dispatching system assigns the hall call based upon the first and second iRSR values.

5. The control system of claim 2, wherein the car status information includes at least one of car position, car direction of movement, door state, car availability and car loading.

6. The control system of claim 1, wherein the first group of elevators comprises elevators that have undergone modernization and the second group of elevators comprises elevators that have not yet undergone modernization.

7. The control system of claim 6, wherein the first system includes a new controller for each elevator connected in a ring elevator communication system.

8. The control system of claim 6, wherein the second system comprises an existing elevator controller for each elevator of the second group and a group controller for assigning hall calls to the existing elevator controllers.

9. The control system of claim 8, wherein when the cross-dispatching system assigns a hall call to the second system, the cross-dispatching system transmits the hall call to the existing group controller.

10. The control system of claim 8, wherein the cross-dispatching system receives car status information from the existing elevator controllers.

11. The control system of claim 8, wherein the cross-dispatching system receives car status information from the existing group controller.

12. A method of controlling operation of elevators during an elevator modernization project, the method comprising:

receiving a hall call;

receiving car status information from a first group of controllers operating new elevators;

receiving car status information from a second group of controllers operating existing elevators;

assigning the hall call to one of the first and second groups of elevators based upon the car status information; and reassigning the hall call based upon updated car status information if the hall call is not serviced within a redispatch time period.

13. The method of claim 12, wherein assigning the hall call based upon the car status information comprises:

calculating an inter-group relative system response (iRSR) value for the first and second groups based on the car status information; and sending the group to receive the hall call based upon a comparison of the iRSR values.

14. The method of claim 12, wherein the car status information includes at least one of car position, car direction of movement, car door state, car availability and car loading.

15. A control system for controlling operation of a first group of elevators that have undergone modernization and a second group of elevators that have not yet undergone modernization, the control system comprising:

a first group of controllers for operating the first group of elevators;

a second group of controllers for operating the second group of elevators; and a cross-dispatching system for receiving hall calls and assigning the hall calls to the first and second groups of controllers based upon inter-group relative system response (iRSR) values for the first and second groups of elevators, wherein the cross-dispatching system reevaluates predicted response times and reassigns a previously assigned hall call if that hall call has not been serviced within a redispatch time period.

16. The control system of claim 15, wherein the cross-dispatching system receives from the first group of controllers car status information for elevators of the first group, and receives from the second group of controllers car status information for elevators of the second group.

17. The control system of claim 16, wherein for each hall call received the cross-dispatching system creates a first inter-group relative system response (iRSR) value based upon the car status information for the first group of elevators, and creates a second inter-group relative system response (iRSR) value based upon the car status information for the second group of elevators.

18. The control system of claim 16, wherein the car status information includes at least one of car position, car direction of movement, door state, car availability and car loading.

19. The control system of claim 15, wherein the second group of controllers comprises an existing elevator controller for each elevator of the second group and a group controller for assigning hall calls to the existing elevator controllers.

20. The control system of claim 19, wherein when the cross-dispatching system assigns a hall call to the second group of controllers, the cross-dispatching system transmits the hall call to the existing group controller.

* * * * *